US010137973B2

(12) United States Patent
Lindeborg et al.

(10) Patent No.: US 10,137,973 B2
(45) Date of Patent: Nov. 27, 2018

(54) PROPULSION CONTROL SYSTEM AND METHOD FOR CONTROLLING A MARINE VESSEL

(71) Applicant: CPAC Systems AB, Göteborg (SE)

(72) Inventors: Mathias Lindeborg, Göteborg (SE); Yoshikazu Nakayasu, Shizuoka (JP)

(73) Assignee: CPAC Systems AB, Göteborg (SE)

( * ) Notice: Subject to any disclaimer, the term of this patent is extended or adjusted under 35 U.S.C. 154(b) by 0 days.

(21) Appl. No.: 15/118,106

(22) PCT Filed: Feb. 12, 2014

(86) PCT No.: PCT/SE2014/000016

§ 371 (c)(1),
(2) Date: Aug. 11, 2016

(87) PCT Pub. No.: WO2015/122805

PCT Pub. Date: Aug. 20, 2015

(65) Prior Publication Data

US 2017/0166290 A1 Jun. 15, 2017

(51) Int. Cl.
*B63H 25/42* (2006.01)
*B63H 20/12* (2006.01)
(Continued)

(52) U.S. Cl.
CPC ..... *B63H 25/42* (2013.01); *B63H 5/08* (2013.01); *B63H 5/125* (2013.01); *B63H 20/12* (2013.01);
(Continued)

(58) Field of Classification Search
CPC ..... B63H 25/42; B63H 5/08; B63H 5/125; B63H 21/21; B63H 20/12
See application file for complete search history.

(56) References Cited

U.S. PATENT DOCUMENTS 8,558,004 B2 10/2013 Li et al.
2012/0197467 A1* 8/2012 Morvillo ..... B63H 11/107 701/21

FOREIGN PATENT DOCUMENTS

WO 2013119175 A1 8/2013
WO 2013122515 A1 8/2013
WO 2013122516 A1 8/2013

OTHER PUBLICATIONS

International Search Report (dated Nov. 10, 2014) for corresponding International App. PCT/SE2014/000016.

* cited by examiner

*Primary Examiner* — Stephen P Avila
(74) *Attorney, Agent, or Firm* — WRB-IP LLP

(57) ABSTRACT

The present disclosure relates to a propulsion control system (30) for controlling a marine vessel (10) comprising at least four propulsion units (20, 22, 24, 26). The marine vessel (10) comprises a longitudinal centre line (L) and a transversal line (T). The transversal line (T) extends in a direction perpendicular to the longitudinal centre line (L) and also extends through the steering axis of the aftmost of the propulsion units. The marine vessel (10) comprises four quadrants (I, II, III, IV) defined by the longitudinal centre line (L) and the transversal line (T) wherein a first (I) and a second (II) quadrant are located on the same side of said longitudinal centre line (L). When a combined sway and yaw motion is desired, the thrust of one propulsion unit is directed towards the second (I) quadrant, and the thrust of the other propulsion units is directed towards the first (II) quadrant.

20 Claims, 6 Drawing Sheets

(51) Int. Cl.

| | |
|---|---|
| ***B63H 25/02*** | (2006.01) |
| ***B63J 99/00*** | (2009.01) |
| ***B63H 5/08*** | (2006.01) |
| ***B63H 5/125*** | (2006.01) |
| ***B63H 21/21*** | (2006.01) |
| *B63H 20/00* | (2006.01) |

(52) U.S. Cl.
CPC ..... *B63H 21/21* (2013.01); *B63H 25/02* (2013.01); *B63J 99/00* (2013.01); *B63H 2020/003* (2013.01); *B63H 2025/026* (2013.01); *B63J 2099/008* (2013.01)

PROPULSION CONTROL SYSTEM AND METHOD FOR CONTROLLING A MARINE VESSEL

BACKGROUND AND SUMMARY

The present disclosure relates to a propulsion control system for controlling a marine vessel. Moreover, the present disclosure relates to a marine vessel. Further, the present disclosure relates to a method for controlling a marine vessel.

The present disclosure can be applied in arty type of marine vessel, such, as larger commercial ships or smaller vessels such as leisure boats and other types of water vehicles or vessels.

Although the present disclosure will be described with respect to a leisure boat, the present disclosure is not restricted to s particular vessel, but may also be used in other vessels such as a larger commercial ship.

Marine vessels of today may be equipped with a plurality of propulsion units for driving the vessel. The propulsion units may be controlled by a propulsion control system.

WO 2013/122516 A1 discloses a marine propulsion control system that is adapted to control a plurality of propulsion units of a marine vessel. The WO 2013/122516 A1 control system may for instance be adapted to control the propulsion units such that a pure sway motion of the vessel is obtained.

Although the WO 2013/122516 A1 control system is suitable for obtaining certain requested motions of the marine vessel hosting the control system, it would be desirable to increase the versatility of such control systems further.

It is desirable to provide a propulsion control system that can be used for controlling a propulsion unit set of a marine vessel in a versatile manner.

As such, one aspect of the present disclosure relates to a propulsion control system for controlling a marine vessel comprising a propulsion unit set which in turn comprises at least four propulsion units. The marine vessel comprises a longitudinal centre line and a transversal line. The transversal line extends in a direction perpendicular to the longitudinal centre line and also extends through the steering axis of the aftmost of the propulsion units. The vessel comprises four quadrants defined by the longitudinal centre line and the transversal line, wherein a first and a second quadrant are located on the same side of the longitudinal centre line. The propulsion control system is adapted to receive an input command from a vessel steering control arrangement.

According to the first aspect of the present disclosure, if the input command is indicative of a combined sway and yaw motion being desired, the propulsion control system is adapted to control the propulsion unit set such that:

- each one of a first, a second, third and fourth propulsion unit of the propulsion unit set produces a thrust in a direction that forms an angle with the longitudinal centre line;
- each one of a first, a second and a third propulsion unit of the propulsion unit set produces a thrust in a direction towards the first quadrant;
- a fourth propulsion unit of the propulsion unit set produces a thrust in a direction towards the second quadrant, and
- the magnitude of the thrust produced by each one of the first and the fourth propulsion unit is greater than the magnitude of the thrust produced by each one of the second and the third propulsion unit.

The above control of the propulsion unit set implies that a motion control of the marine vessel in which a combined sway and yaw motion is obtained in a straightforward manner. Moreover, the control of the propulsion unit set as presented hereinabove implies that a change between a pure sway motion and a combined sway and yaw motion, and vice versa, can be obtained without necessarily have to shift gears of any one of the four propulsion units. This in turn implies the possibility to obtain a swift change between a pure sway motion and a combined sway and yaw motion.

The above possibility may for instance be desired when the marine vessel 10 is in a docking mode, i.e. when the marine vessel 10 is involved in a docking manoeuvre.

Optionally, the first quadrant is located aft of the transversal line such that each one of the first, second and third propulsion unit has a reverse gear selection when producing the thrust.

In an example where the propulsion unit is an outboard engine for instance, the maximum thrust producible when the propulsion unit has a reverse gear selection is generally lower than the maximum thrust producible when the propulsion unit has a forward gear selection. As such, with a configuration such as the one presented hereinabove, it may be straightforward to obtain comparable thrusts in the forward and rearward directions such that the sum of the thrusts results in a combined sway and yaw motion for instance.

Optionally, the propulsion control system is adapted to individually control each one of the first, second, third and fourth propulsion unit. An individual control implies an increased possibility to e.g. obtain a transition from a sway and yaw motion to a sway motion or vice versa.

A second aspect of the present disclosure relates to a marine vessel comprising a first, a second, a third and a fourth propulsion unit. The marine vessel further comprises a propulsion control system according to the first aspect of the present invention.

A third aspect of the present disclosure relates to a method for controlling a marine vessel comprising a propulsion unit set which in turn comprises four propulsion units. The marine vessel comprises a longitudinal centre line and a transversal line, the transversal line extending in a direction perpendicular to the longitudinal centre line and also extends through the steering axis of the aftmost of the propulsion units. The vessel comprises four quadrants defined by the longitudinal centre line and the transversal line, wherein a first and a second quadrant are located on the same side of the longitudinal centre line.

The method according the third aspect of the present disclosure comprises:

- receiving instructions indicative of a combined sway and yaw motion being desired, and
- controlling the propulsion unit set such that:
  - each one of a first, a second, third and fourth propulsion unit of the propulsion unit set produces a thrust in a direction that forms an angle with the longitudinal centre line;
  - each one of a first, a second and a third propulsion unit of the propulsion unit set produces a thrust in a direction towards the first quadrant;
  - a fourth propulsion unit of the propulsion unit set produces a thrust in a direction towards the second quadrant, and
  - the magnitude of the thrust produced by each one of the first and the fourth propulsion unit is greater than the magnitude of the thrust produced by each one of the second and the third propulsion unit.

A fourth aspect of the present disclosure relates to a computer program comprising program code means for performing the steps of the third aspect of the present disclosure when the program is run on a computer.

A fifth aspect of the present disclosure relates to a computer readable medium carrying a computer program comprising program code means for performing the steps of the third aspect of the present disclosure when the program product is run on a computer.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
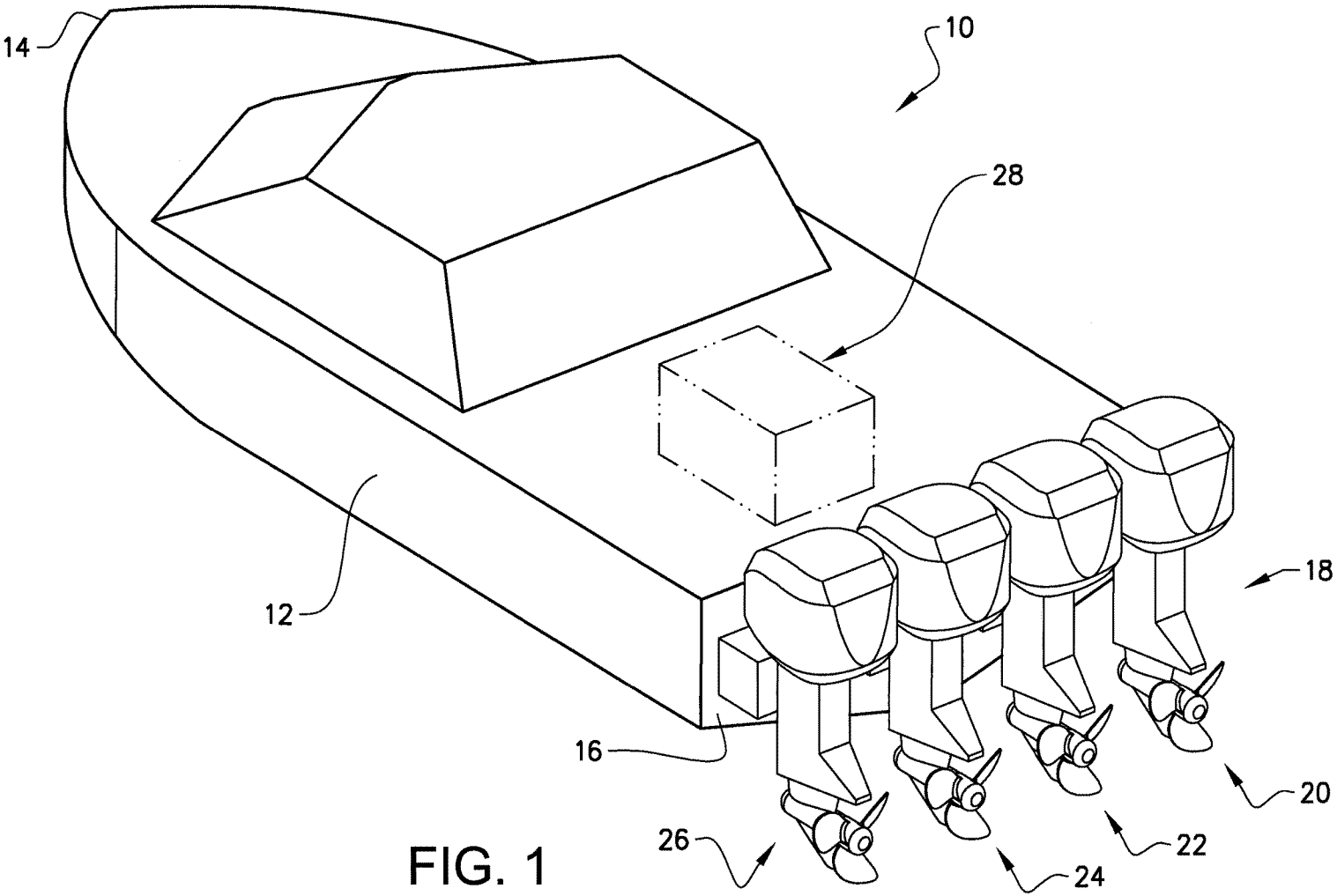
FIG. 1 is a schematic perspective view of a marine vessel.

The present invention will be described more fully hereinafter with reference to the accompanying drawings, in which preferred embodiments of the invention are shown. The inventive concept may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

Moreover, a propulsion control system for a set of marine propulsion units comprising four propulsion units is mainly discussed. It should however be noted that this by no means should limit the scope of the application, which is equally applicable to a set of marine propulsion units which could comprise more than four propulsion units.

FIG. 1 illustrates a schematic perspective view of a marine vessel 10. Generally, the propulsion control system according to an embodiment of the invention may be used in any type of vessel, such as larger commercial ships, smaller vessels such as leisure boats and other types of water vehicles or vessels. The invention is particularly useful for small leisure boats, but it is nevertheless not limited to such type of water vehicle only.

FIG. 1 further illustrates that the marine vessel 10 comprises a hull 12 which in turn comprises a bow 14 and a stem 16. Moreover, the marine vessel 10 comprises a propulsion unit set 18 which in turn comprises at least four propulsion units 20, 22, 24, 26.

Each one of the propulsion units 20, 22, 24, 26 is generally arranged at the stem 16. However, it is also envisaged that one or more of the propulsion units 20, 22, 24, 26 may be located forward of the stem 16.

Preferably, each one of the propulsion units 20, 22, 24, 26 may comprise a propeller assembly (not shown) each one of which comprising one of more propellers. However, as a non-limiting example, one or more of the propulsion units 20, 22, 24, 26 may comprise another type of thrust generating means, such as a water jet arrangement for instance.

Each one of the propulsion units 20, 22, 24, 26 is adapted to provide a propulsion thrust along a thrust axis. For instance, the boat 10 may comprise an engine 28, such as an internal combustion engine, which in turn is mechanically connected to the propulsion unit set 18 via a transmission shaft (not shown).

However, it is also envisaged that each one of the propulsion units 20, 22, 24, 26 may be an outboard engine. As such, each one of the drive units may comprise an individual engine (not shown) that is dedicated to drive one propulsion unit. Moreover, it is also envisaged that a marine vessel 10 may comprise a combination of at least one propulsion unit that is connected to an internal engine as well as at least one outboard engine.

In the examples hereinbelow, each one of the propulsion units 20, 22, 24, 26 is an outboard engine.

Figure 2:
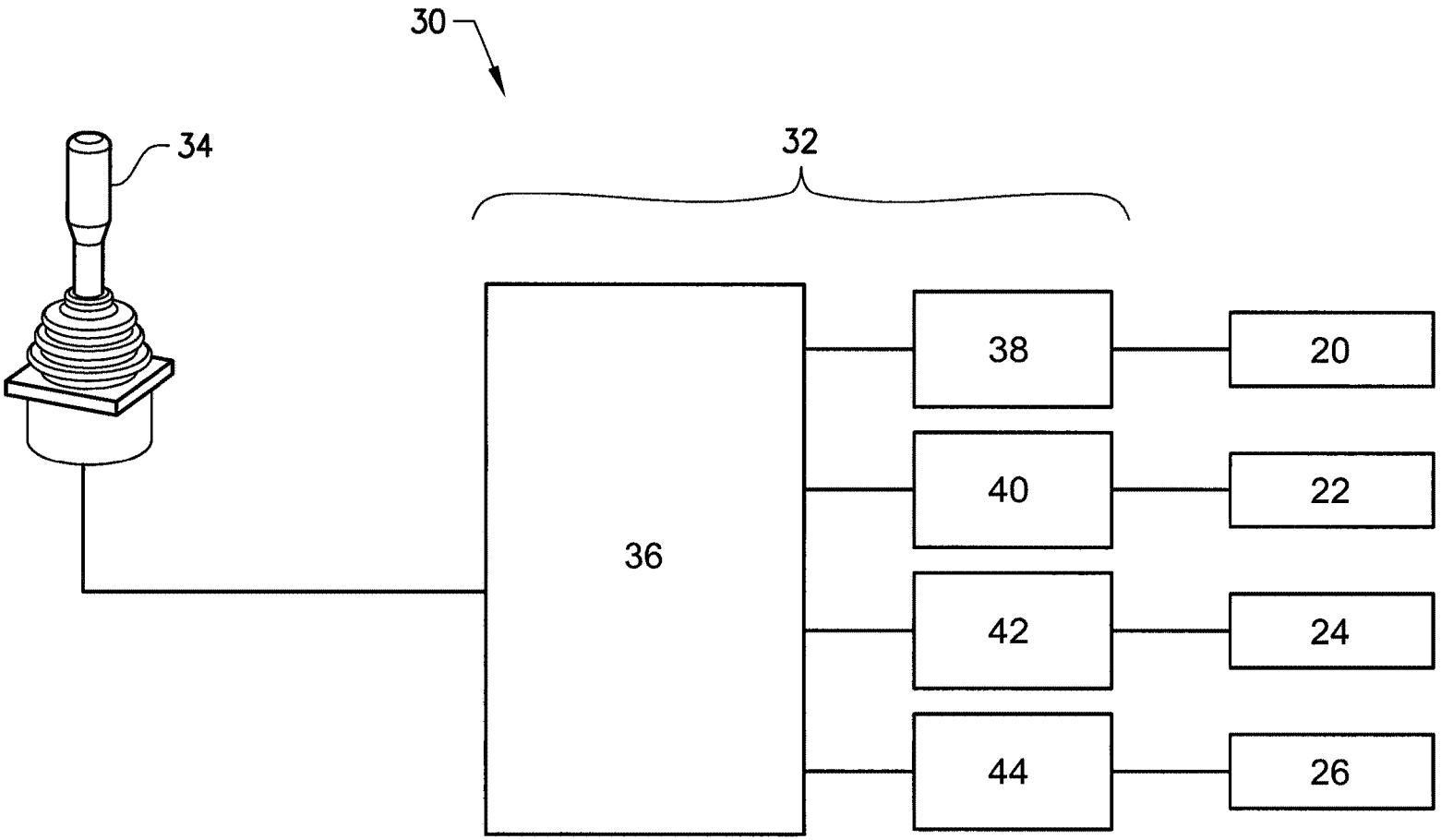
FIG. 2 is a schematic perspective view of a propulsion control system.

FIG. 2 illustrates an embodiment of a propulsion control system 30. As may be gleaned from FIG. 2, the control system 30 may comprise a control unit 32 such as an electronic control unit. The control unit 32 is preferably adapted to be in communication with one or more control arrangements. In the FIG. 2 embodiment, the control unit 32 is connected to a joystick 34. However, it should be noted that the FIG. 2 joystick 34 merely serves as an example of a control arrangement. As such, it is envisaged that other embodiments of the propulsion control system 30 may, instead of, or in addition to, the joystick 34 be adapted to communicate with, a stick, a set of buttons, a touch screen or equivalent.

The control unit 32 may be adapted to control the magnitude and direction of the thrust that is produced by each one of the propulsion units 20, 22, 24, 26.

Purely by way of example, the control unit 32 may comprise a common control unit 36 that is adapted to control each one of the propulsion units 20, 22, 24, 26, e.g. jointly or individually. As another non-limiting example, the control unit 32 may comprise a first 38, second 40, third 42 and fourth 44 engine control unit each one of which is associated with one of the propulsion units 20, 22, 24, 26. It is also envisaged that implementations of the control unit 32 may comprise a common control unit 36 as well as a plurality of propulsion unit specific engine control units. Such an implementation is illustrated in FIG. 2.

As a non-limiting example, the control unit 32 may comprise a computer program and/or a computer readable medium.

Purely by way of example, at least in an implementation in which the propulsion units are outboard engines, each propulsion unit 20, 22, 24, 26 may include a gear selector (not shown), a steering actuator (not shown), and a steering angle detecting section (not shown). The gear selector may change gear selection for each propulsion unit between a forward propulsion position, a reverse propulsion position, and a neutral position.

Furthermore, the steering actuator is adapted to turn a propulsion unit 20, 22, 24, 26 about a steering axis to thereby alter the steering angle thrust direction. The steering actuator may include a hydraulic cylinder and/or an electrical motor. The steering angle detecting section is adapted to detect an actual steering angle propulsion unit. If the steering actuator is a hydraulic cylinder, then the steering angle detecting section may be a stroke sensor for the hydraulic cylinder. However, the steering angle detecting section may be any means for measuring or calculating the steering angle.

Moreover, the steering actuator may be integrated with its associated propulsion unit. Optionally, the steering actuator may be mounted externally of the propulsion unit.

Furthermore, the control unit 10 may preferably contain means for mapping an input signal from one or more of the steering control instruments into a reference value angle for respective propulsion unit 20, 22, 24, 26 where the steering actuators are arranged to move the propulsion units such that they assume the requested steering angle.

The mapping may be of simple type such that a steering angle is obtained from the steering control instruments and that the steering actuator uses this input command as the reference value angle. The mapping may also be more complex such that the reference value angles are calculated in dependence of the driving situation including for instance speed, desired trim angle, whether docking is performed such that sway of the vessel is desired and so forth.

Figure 3:
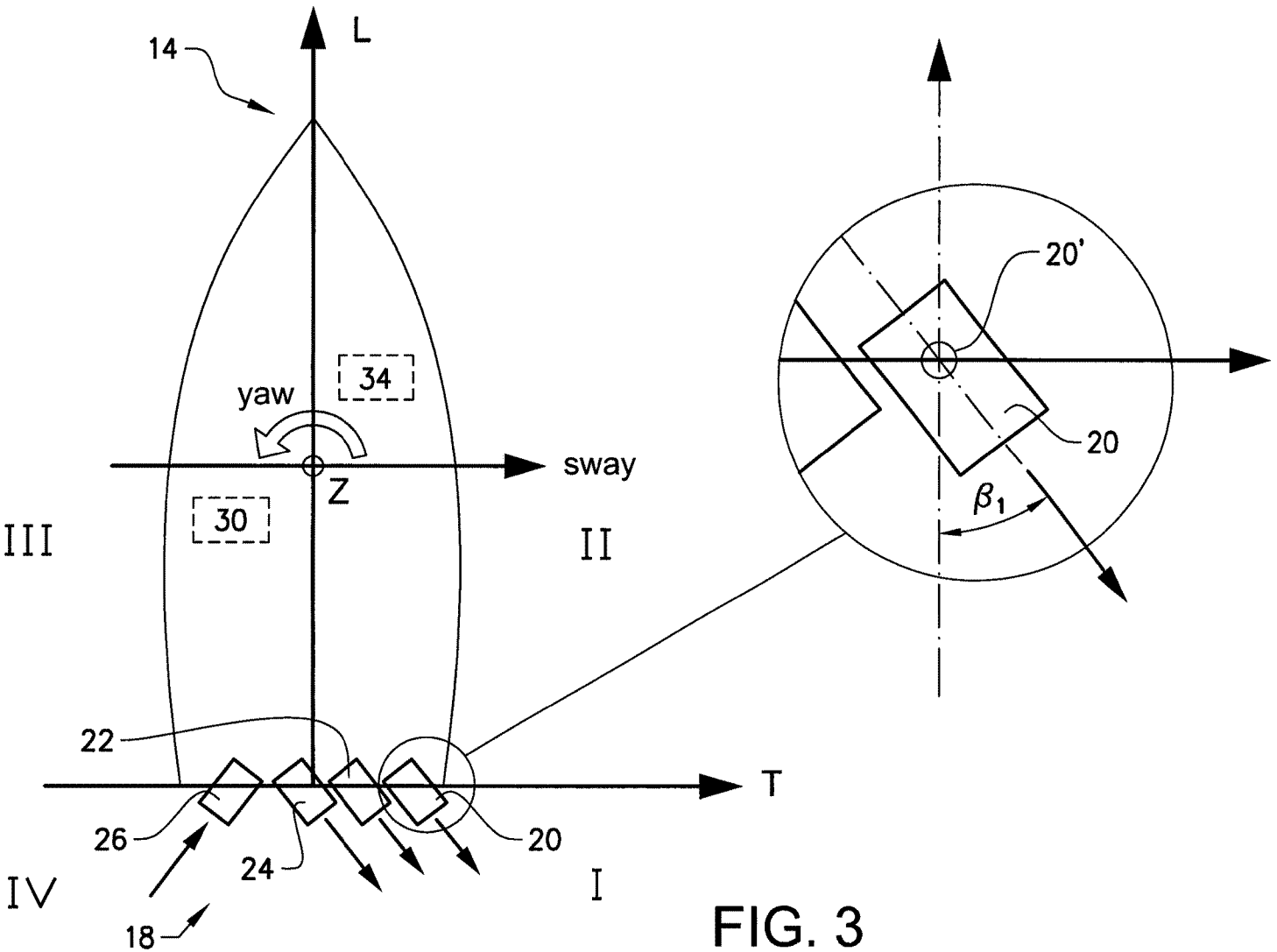
FIG. 3 is a schematic top view of a marine vessel.

FIG. 3 is a top view of a marine vessel 10 which comprises an embodiment of the propulsion control system 30. Moreover, the marine vessel 10 comprises a propulsion unit set 18 which in turn comprises at least four propulsion units 20, 22, 24, 26.

As is indicated in FIG. 3, the marine vessel 10 comprises a longitudinal centre line L and a transversal line T. The transversal line T extends in a direction perpendicular to the longitudinal centre line L and also extends through the steering axis of an aftmost of the propulsion units 20, 22, 24, 26. As used herein, the expression "aftmost" relates to the propulsion unit the steering axis of which is located at the largest distance, along the longitudinal centre line L, from the bow 14 of the marine vessel 10.

If two or more propulsion units are located at the same largest distance from the bow 14, such as in the implementation illustrated in FIG. 3 in which all four propulsion units are located at the same distance along the longitudinal direction L from the bow 14, the transversal line T will extend through the steering axis of each one of these propulsion units.

Further, FIG. 3 illustrates the direction of a sway motion which generally is a motion in a direction parallel to the transversal line T. Moreover, FIG. 3 illustrates the direction of a yaw motion which generally is a rotation around a vertical axis Z that extends from the marine vessel 10. Generally, the vertical axis Z extends through, or at least close to, the horizontal centre of buoyancy of the marine vessel 10.

Additionally, FIG. 3 illustrates that each one of the propulsion units 20, 22, 24, 26 assumes a non-zero drive unit steering angle. The definition of a steering angle will hereinafter be presented with reference to the outermost propulsion unit 20 on the starboard side, hereinafter referred to as the outermost starboard propulsion unit 20. However, it should be noted that the definition is equally applicable for each one of the other propulsion units of the propulsion unit set 18.

FIG. 3 illustrates the outermost starboard propulsion unit 20 in a condition in which it assumes a non-zero drive unit steering angle $\beta l$. As such, the outermost starboard propulsion unit 20 in the FIG. 3 condition is pivoted around its steering axis 20'. As used herein, a zero steering angle is indicative of that the drive unit provides a thrust in a direction that is parallel to the longitudinal centre line L. Moreover, as used herein, a positive steering angle fi is indicative of that the drive unit is pivoted counter-clockwise around its steering axis 20'. In a similar way, a negative steering angle fa is indicative of that the drive unit is pivoted clockwise around its steering axis 20'. In the FIG. 3 configuration, the outermost starboard propulsion unit 20 assumes a positive drive unit steering angle fa.

Further, as is indicated in FIG. 3, the vessel comprises four quadrants I, II, III, IV defined by the longitudinal centre line L and the transversal line T, wherein a first and a second quadrant I, II are located on the same side of the longitudinal centre line L. Consequently, the third and fourth quadrants are located on the same side of the longitudinal centre line L.

As such, the first and a second quadrant I, II may for instance, depending on the direction of the motion that the marine vessel 10 is imparted, be located on the starboard side of the longitudinal centre line L whereas the third and fourth quadrant may be located on the portside of the longitudinal centre line L.

As has been intimated hereinabove, the propulsion control system 30 is adapted to receive an input command from a vessel steering control arrangement 34, e.g. a joystick.

Moreover, if the input command is indicative of a combined sway and yaw motion being desired, the propulsion control system 30 is adapted to control the propulsion unit set 18 such that:

- Each one of a first, a second, third and fourth propulsion unit 20, 22, 24, 26 of the propulsion unit set 18 produces a thrust in a direction that forms an angle with the longitudinal centre line L. In other words, each one of the propulsion units 20, 22, 24, 26 produces a thrust in a direction that is non-parallel with the longitudinal centre line L. As such, each one of the propulsion units 20, 22, 24, 26 assumes a non-zero drive unit steering angle.
- Each one of a first 24, a second 20 and a third 22 propulsion unit of the propulsion unit set 18 produces a thrust in a direction towards the first quadrant I.
- A fourth propulsion unit 26 of the propulsion unit set produces a thrust in a direction towards the second quadrant II.

Furthermore, the propulsion control system 30 is adapted to control the propulsion unit set 18 such that the magnitude of the thrust produced by each one of the first 24 and the fourth propulsion unit 26 is greater than the magnitude of the thrust produced by each one of the second 20 and the third 22 propulsion unit.

As a non-limiting example, the magnitude of the thrust produced by each one of the first 24 and the fourth propulsion unit 26 may be at least 10% greater than, preferably at least 20% greater than, more preferred at last 30% greater than the largest magnitude of the thrust that is produced by each one of the second 20 and the third 22 propulsion unit.

The above feature that each one of a first 24, a second 20 and a third 22 propulsion unit of the propulsion unit set 18 produces a thrust in a direction towards the first quadrant I indicates that the sign of the drive unit steering angle of each one of the first 24, a second 20 and a third 22 propulsion units are the same. Moreover, as an example, the value of the steering angles of the first 24, a second 20 and a third 22 propulsion units may be similar. As a non-limiting example, in the above configuration of the propulsion units, which have been set in order to obtain a combined sway and yaw motion, the absolute value of the difference between the largest and smallest steering angle of the first 24, a second 20 and a third 22 propulsion units may be within the range of 5°.

As may be realized from the above, the feature that each one of a first, a second and a third propulsion unit 20, 22, 24 produces a thrust in a direction towards the first quadrant I whereas the fourth propulsion unit 26 of the propulsion unit set produces a thrust in a direction towards the second quadrant II, wherein the first and second quadrants I, II are located on the same side of the longitudinal centre line L, comprises the following configuration options a) to d):

a) Each one of the first, a second and a third propulsion unit 20, 22, 24 has reverse gear selection and a positive drive unit steering angle whereas the fourth propulsion unit 26 has a forward gear selection and a negative drive unit steering angle.

b) Each one of the first, a second and a third propulsion unit 20, 22, 24 has forward gear selection and a positive drive unit steering angle whereas the fourth propulsion unit 26 has a reverse gear selection and a negative drive unit steering angle.

c) Each one of the first, a second and a third propulsion unit 20, 22, 24 has reverse gear selection and a negative drive unit steering angle whereas the fourth propulsion unit 26 has a forward gear selection and a positive drive unit steering angle.

d) Each one of the first, a second and a third propulsion unit 20, 22, 24 has forward gear selection and a negative drive unit steering angle whereas the fourth propulsion unit 26 has a reverse gear selection and a positive drive unit steering angle.

FIG. 3 illustrates the propulsion units 20, 22, 24, 26 in a configuration in which the first quadrant is located aft of the transversal line T such that each one of the first, second and third propulsion unit 20, 22, 24 has a reverse gear selection when producing the thrust.

A configuration in which the first quadrant is located aft of the transversal line T encompasses each one of the configuration options a) and c) that have been presented hereinabove. In particular, FIG. 3 illustrates configuration option a).

As used herein, the expressions "first", "second", "third" and "fourth" propulsion units relates to the configuration of the propulsion unit concerned when the propulsion unit set is configured for a specific motion. As such, in the event that a combined sway and yaw motion is desired, the expressions "first", "second", "third" and "fourth" propulsion units relate to the following:

- the first propulsion unit produces a thrust towards the same quadrant as the second and third propulsion units;
- the thrust magnitude produced by the first propulsion unit is greater than the thrust magnitude produced by each one of the second and third propulsion unit;
- the fourth propulsion unit produces a thrust towards the other quadrant on the same side of the longitudinal centre line L as compared to the first, second and third propulsion units and
- the thrust magnitude produced by the fourth propulsion unit is greater than the thrust magnitude produced by each one of the second and third propulsion unit.

As such, the expression "first propulsion unit", for instance, need not necessarily be linked to the propulsion unit that is indicated by reference numeral 24 in the appended drawings. Instead, the expression "first propulsion unit" relates to the configuration that the propulsion unit assumes, i.e. producing a thrust towards the same quadrant as the second and third propulsion units with a thrust magnitude exceeding the thrust magnitude of each one of the second and third propulsion units, when the marine vessel 10 hosting the propulsion units is imparted a combined sway and yaw motion.

The fourth propulsion unit, the thrust of which is directed towards another quadrant than the thrust of each one of the first, a second and a third propulsion units, may for instance be one of the outermost, as seen along the transversal line T, of the first, second, third and fourth propulsion units. Such an implementation is illustrated in the FIG. 3 configuration in which the fourth propulsion unit is the propulsion unit indicated with reference numeral 26. The above configuration may have the advantage of having a low risk of interference between the thrust produced by the various propulsion units. However, it is also envisaged that the fourth propulsion unit may located between the outermost propulsion units of the propulsion unit set 18.

In the FIG. 3 configuration, the marine vessel 10 is imparted a positive sway motion, i.e. ε sway motion towards the starboard side of the marine vessel 10. In such a configuration the fourth propulsion unit may preferably be the outermost of the propulsion units and also be located portside of each one of the other propulsion units. However, in a configuration in which the marine vessel 10 is imparted a negative sway motion, i.e. a sway motion towards the portside of the marine vessel 10, the fourth propulsion unit may preferably be the outermost of the propulsion units and also be located on the starboard side of each one of the other propulsion units.

Moreover, FIG. 3 illustrates a configuration in which the first and fourth propulsion units, i.e. the propulsion units that have a thrust magnitude that exceeds the thrust magnitude of the second and the third propulsion unit, are adjacent. In other words, there is no propulsion unit located between the first and fourth propulsion units in the FIG. 3 configuration. Such a configuration may be implemented by the arrangement in FIG. 3 in which the first propulsion unit is the propulsion unit indicated with reference numeral 24 and the fourth propulsion unit is the propulsion unit indicated with reference numeral 26.

Figure 4:
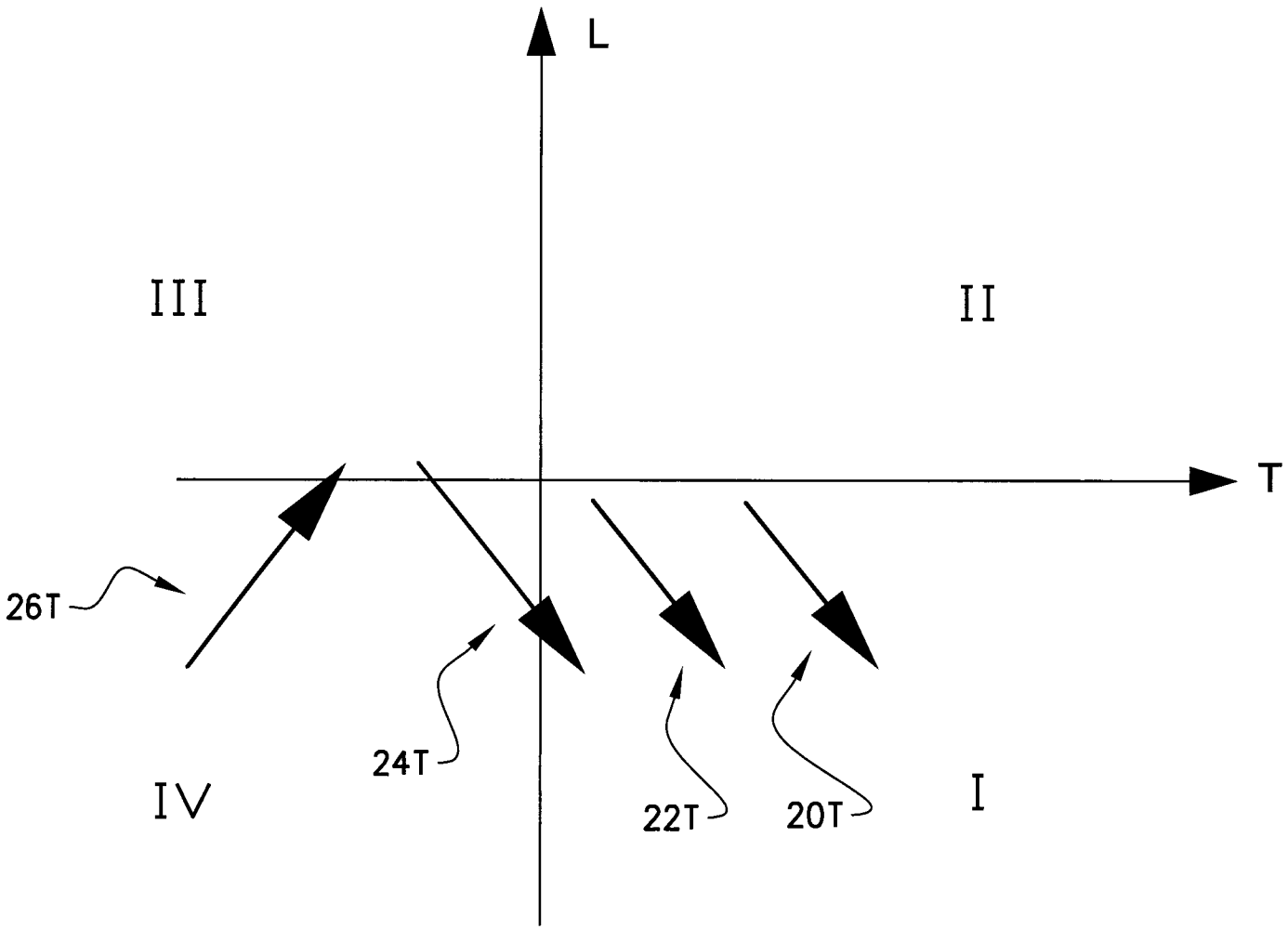
FIG. 4 is a stylized image of the thrusts produced by the propulsion units of a marine vessel when the propulsion units are arranged such that the marine vessel is imparted a combined sway and yaw motion.

FIG. 4 illustrates a stylized image of the magnitude and direction of the thrust 20T, 22T, 24T, 26T that is produced by each one of the units when the propulsion units are in the FIG. 3 configuration. The sum of the thrust produced by the propulsion units results in a combined sway and yaw motion of the marine vessel (not shown in FIG. 4).

Moreover, the magnitude and direction of the thrusts 20T, 22T, 24T, 26T illustrated in FIG. 4 indicate that the each one of the thrusts 20T, 22T, 24T associated with the first three propulsion units are directed towards a first quadrant I, whereas the thrust 26T of the fourth propulsion unit is directed towards the second quadrant II.

Further, FIG. 4 illustrates that the magnitude of the thrust 24T, 26T produced by each one of the first and the fourth propulsion unit is greater than the magnitude of the thrust 20T, 22T produced by each one of the second and the third propulsion unit.

As has previously been indicated, the magnitude of the thrust 24T, 26T produced by each one of the first and the fourth propulsion unit may be 10% greater than, preferably at least 20% greater than, more preferred at last 30% greater than the magnitude of the thrust 20T, 22T of the second and the third propulsion unit that produces the largest magnitude of the thrust in the above configuration.

Moreover, when the propulsion units assume a condition for obtaining a combined sway and yaw motion, such as in the example configuration indicated in FIG. 4, the absolute value of the steering angle of each one of the propulsion units may be within the range of 15 to 45°. As such, in the FIG. 4 configuration, the steering angle of each one of the first, second and third propulsion unit may be within the range of 15 to 45° whereas the steering angle of the fourth propulsion unit may be within the range of −45 to −15°. As a non-limiting example, the absolute values of the steering angles of each one of the propulsion units may be as large as possible, in view of constraints such as spatial constraints and constraints in the steering actuators (not shown in FIG. 4) for example, in the FIG. 4 configuration.

The configuration illustrated in FIG. 4 implies that the motion of the marine vessel 10 may be changed from a combined sway and yaw motion to a pure sway motion in a straightforward manner. As such, if the input command is indicative of a switch from the combined sway and yaw motion to a pure sway motion being desired, the propulsion control system is adapted to control the propulsion unit set such that:

the thrust produced by each one of the first 24 and fourth 26 propulsion unit is decreased and the thrust produced by each one of the second 20 and third 22 propulsion unit is increased.

Figure 5:
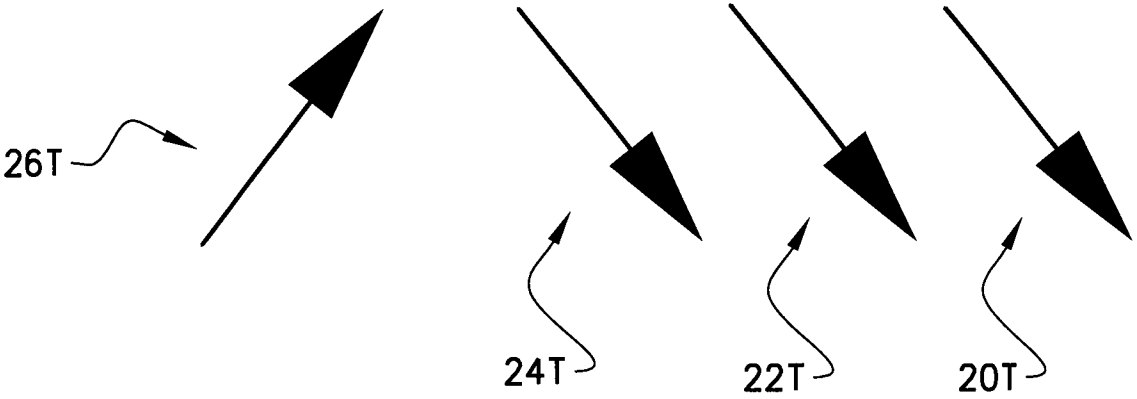
FIG. 5 is a stylized image of the thrusts produced by the propulsion units of a marine vessel when the propulsion units are arranged such that the marine vessel is imparted a pure sway motion.

An example of a configuration such as the one presented hereinabove is illustrated in FIG. 5. As may be realized when comparing the FIG. 4 and FIG. 5 configurations, a switch from a combined sway and yaw motion to a pure sway motion may be obtained without the need of changing the main direction of the thrust, i.e. from positive to negative thrust or vice versa.

When the propulsion units have assumed the FIG. 5 configuration, the largest magnitude of the thrust produced by any one of the four propulsion units is preferably less than 10%, more preferred less than 5%, above the smallest magnitude of the thrust produced by any one of the four propulsion units.

Furthermore, if the input command is indicative of a switch from the sway and yaw motion to a pure sway motion being desired, the propulsion control system may further be adapted to control the propulsion unit set such that the direction of the thrust 24T, 26T produced by each one of the first and fourth propulsion units is changed from a first direction to a second direction wherein the first direction is closer to the extension direction of the transversal line as compared to the second direction. In other words, the absolute value of the steering angle associated with the first direction is larger than the absolute value associated with the second direction.

When the propulsion units assume a condition for obtaining a pure sway motion, such as in the example configuration indicated in FIG. 5, the absolute value of the steering angle of each one of the first and fourth propulsion units may be within the range of 10 to 30°, preferably within the range of 15 to 25°. As such, in the FIG. 5 configuration, the steering angle of the first propulsion unit may be within the range of 10 to 30°, preferably within the range of 15 to 25°, whereas the steering angle of the fourth propulsion unit may be within the range of −30 to −10°, preferably within the range of −25 to −15°.

As a non-limiting example, when the propulsion units assume a condition for obtaining a combined sway and yaw motion, such as the condition illustrated in FIG. 4, the absolute value of the steering angle of each one of the first and fourth propulsion units may be within the range of 5 to 15° more than the absolute value of the steering angle of each one of the first and fourth propulsion units when the propulsion units assume a condition for obtaining a pure sway motion, such as the condition illustrated in FIG. 5. Thus, though purely by way of example, if the steering angle of e.g. the first propulsion unit is 20° in the FIG. 5 condition, the steering angle of the first propulsion unit in the FIG. 4 condition may be within the range of 25° to 35°.

Moreover, if the input command is indicative of a switch from the sway and yaw motion to a pure sway motion being desired, the propulsion control system may further be adapted to control the propulsion unit set such that the direction of the thrust produced by each one of the first and fourth propulsion units is changed from a first direction to a second direction wherein the first direction is closer to the extension direction of the transversal line as compared to the second direction. As such, absolute value of the steering angle associated with the second direction is smaller than the absolute value of the steering angle associated with the first direction.

When the propulsion units assume a condition for obtaining a pure sway motion, such as in the example configuration indicated in FIG. 5, the absolute value of the steering angle of each one of the second 20 and third 22 propulsion units may be within the range of 10 to 30°, preferably within the range of 15 to 25°. As such, in the FIG. 5 configuration, the steering angle of each one of the second 20 and third 22 propulsion units may be within the range of 10 to 30°, preferably within the range of 15 to 25°. As a non-limiting example, when the propulsion units assume a condition for obtaining a combined sway and yaw motion, such as the condition illustrated in FIG. 4, the absolute value of the steering angle of each one of the second and third propulsion units may be within the range of 5 to 15° more than the absolute value of the steering angle of each one of the second and third propulsion units when the propulsion units assume a condition for obtaining a pure sway motion, such as the condition illustrated in FIG. 5.

Figure 6:
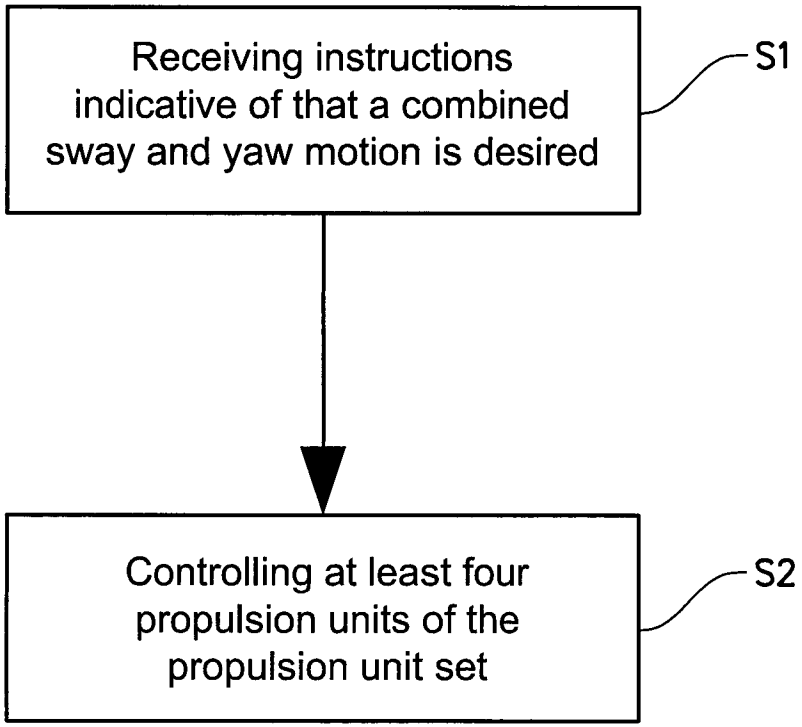
FIG. 6 is a flow-chart illustrating an embodiment of a method for controlling a marine vessel.

FIG. 6 illustrates a flow chart illustrating steps of an embodiment of the method for controlling a marine vessel. As may be gleaned from FIG. 6, the method may comprise a step S1 of receiving instructions indicative of a combined sway and yaw motion being desired. Such instructions may for instance by sent from one or more control arrangements, such as a joystick (not shown in FIG. 6), and received by a portion of a control unit (not shown in FIG. 6).

Moreover, the embodiment of the method illustrated in FIG. 6 comprises controlling at least four propulsion units of the propulsion unit set in order to obtain the combined sway and yaw motion. Such control may for instance be performed using the control unit (not shown in FIG. 6).

It is to be understood that the present invention is not limited to the embodiments described above and illustrated in the drawings, rather, the skilled person will recognize that many changes and modifications may be made within the scope of the appended claims.

The invention claimed is:

1. A propulsion control system for controlling a marine vessel comprising a propulsion unit set which in turn comprises at least four propulsion units, the marine vessel comprising a longitudinal centre line and a transversal line, the transversal line extending in a direction perpendicular to the longitudinal centre line and also extends through the steering axis of an aftmost of the propulsion units, the marine vessel comprising four quadrants defined by the longitudinal centre line and the transversal line, wherein a first and a second quadrant are located on the same side of the longitudinal centre line, the propulsion control system being adapted to receive an input command from a vessel steering control arrangement, wherein, if the input command is indicative of a combined sway and yaw motion being desired, the propulsion control system is adapted to control the propulsion unit set such that:

each one of a first, a second, a third and a fourth propulsion unit of the propulsion unit set produces a thrust in a direction that forms an angle with the longitudinal centre line;

each one of the first, second and third propulsion unit of the propulsion unit set produces a thrust in a direction towards the first quadrant;

the fourth propulsion unit of the propulsion unit set produces a thrust in a direction towards the second quadrant, and the magnitude of the thrust produced by each of the first and the fourth propulsion unit is greater than the magnitude of the thrust produced by each one of the second and the third propulsion unit.

2. The propulsion control system according to claim 1, wherein the first quadrant is located aft of the transversal line such that each one of the first, second and third propulsion unit has a reverse gear selection when producing the thrust.

3. The propulsion control system according to claim 1, wherein the fourth propulsion unit is one of the outermost, as seen along the transversal line, of the first, second, third and fourth propulsion units.

4. The propulsion control system according to claim 1, wherein the first and fourth propulsion units are adjacent.

5. The propulsion control system according to claim 1, wherein the propulsion control system is adapted to individually control each one of the first, second, third and fourth propulsion units.

6. The propulsion control system according to claim 1, wherein, if the input command is indicative of a switch from the combined sway and yaw motion to a pure sway motion being desired, the propulsion control system is adapted to control the propulsion unit set such that:

the thrust produced by each one of the first and fourth propulsion unit is decreased and the thrust produced by each one of the second and third propulsion unit is increased.

7. The propulsion control system according to claim 1, wherein, if the input command is indicative of a switch from the sway and yaw motion to a pure sway motion being desired, the propulsion control system is further adapted to control the propulsion unit set such that:

the direction of the thrust produced by each one of the first and fourth propulsion units is changed from a first direction to, a second direction wherein the first direction is closer to the extension direction of the transversal line as compared to the second direction.

8. The propulsion control system according to claim 1, wherein, if the input command is indicative of a switch from the sway and yaw motion to a pure sway motion being desired, the propulsion control system is further adapted to control the propulsion unit set such that:

the direction of the thrust produced by each one of the second and third propulsion units is changed from a first direction to a second direction wherein the first direction is closer to the extension direction of the transversal line as compared to the second direction.

9. A marine vessel comprising a first, a second, a third and a fourth propulsion unit, the marine vessel further comprising a propulsion control system according to claim 1.

10. The marine vessel according to claim 9, wherein each one of the first, second, third and fourth propulsion units comprises an outboard engine.

11. A method for controlling a marine vessel comprising a propulsion unit set which in turn comprises four propulsion units, the marine vessel comprising a longitudinal centre line and a transversal line, the transversal line extending in a direction perpendicular to the longitudinal centre line and also extends through the steering axis of the aftmost of the propulsion units, the vessel comprising four quadrants defined by the longitudinal centre line and the transversal line, wherein a first and a second quadrant are located on the same side of the longitudinal centre line, comprising:

receiving instructions indicative of a combined sway and yaw motion being desired, and controlling the propulsion unit set such that:

each one of a first, a second, a third and a fourth propulsion unit of the propulsion unit set produces a thrust in a direction that forms an angle with the longitudinal centre line;

each one of the first, second and third propulsion unit of the propulsion unit set produces a thrust in a direction towards the first quadrant;

the fourth propulsion unit of the propulsion unit set produces a thrust in a direction towards the second quadrant, and o the magnitude of the thrust produced by each one of the first and the fourth propulsion unit is greater than the magnitude of the thrust produced by each one of the second and the third propulsion unit.

12. The method according to claim 11, wherein the first quadrant is located aft of the transversal line such that each one of the first, second and third propulsion unit has a reverse gear selection when producing the thrust.

13. The method according to claim 11, wherein the fourth propulsion unit is one of the outermost, as seen along the transversal line, of the first, second, third and fourth propulsion units.

14. The method according to claim 11, wherein the first and the fourth propulsion units are adjacent.

15. The method according to claim 11, wherein the method comprises individually controlling each one of the first, second, third and fourth propulsion units.

16. The method according to claim 11, wherein the method comprises:

receiving instructions indicative of a switch from the combined sway and yaw motion to a pure sway motion being desired, and controlling the propulsion unit set such that the pure sway motion obtained by:

decreasing the thrust produced by each one of the first and fourth propulsion units and increasing the thrust produced by each one of the second and third propulsion unit.

17. The method according to claim 16, wherein the step of controlling the propulsion unit set such that the pure sway motion is obtained further comprises:

changing the direction of the thrust produced by each one of the first and fourth propulsion units from a first direction to a second direction wherein the first direction is closer to the extension direction of the transversal line as compared to the second direction.

18. The method according to claim 16, wherein the step of controlling the propulsion unit set such that the pure sway motion is obtained further comprises:

changing the direction of the thrust produced by each one of the second and third propulsion units from a first direction to a second direction wherein the first direction is closer to the extension direction of the transversal line as compared to the second direction.

19. A computer comprising a program configured for performing the steps of claim 11 in the marine vessel when the program is run on the computer.

20. A non-transitory computer readable medium carrying a computer program configured for performing the steps of claim 11 in the marine vessel when the program product is run on a computer.

* * * * *